US005244126A

United States Patent [19]

Geier

[11] Patent Number: 5,244,126

[45] Date of Patent: Sep. 14, 1993

[54] MANUAL SPRAYER DEVICE WITH A PISTON-CONTROLLED COMPENSATION VALVE

[75] Inventor: Adalberto Geier, Villazzano, Italy

[73] Assignee: Coster Tecnologie Speciali SpA, Italy

[21] Appl. No.: 915,413

[22] Filed: Jul. 14, 1992

[30] Foreign Application Priority Data

Aug. 30, 1991 [IT] Italy ..... MI91A002332

[51] Int. Cl.[5] ..... B65D 47/34

[52] U.S. Cl. ..... 222/383; 239/333

[58] Field of Search ..... 222/333, 372, 382, 383, 222/481–484; 239/321, 333, 493; 137/526

[56] References Cited

U.S. PATENT DOCUMENTS 4,815,663 3/1989 Tada ..... 239/333

4,958,754 9/1990 Dennis ..... 222/383

FOREIGN PATENT DOCUMENTS 1566680 5/1980 United Kingdom .

*Primary Examiner*—Jesus D. Sotelo

*Attorney, Agent, or Firm*—Steinberg & Raskin

[57] ABSTRACT

The sprayer device comprises a trigger lever (44) which operates a piston (40) movable within a cylinder (20). The piston (40) comprises an intermediate sunken portion or groove (42) which cooperates with a compensation valve (18) to enable it to close when the piston (40) is substantially at the end of its suction stroke, i.e. in its rest position. During the course of its movement, the piston (40) opens the compensation valve (18).

10 Claims, 2 Drawing Sheets

MANUAL SPRAYER DEVICE WITH A PISTON-CONTROLLED COMPENSATION VALVE

This invention relates to a liquid sprayer device fixable to a container containing the liquid to be dispensed and comprising a body, a trigger lever rotatably mounted within the body, a cylinder within said body, a piston movable within the cylinder and controlled by the trigger lever, elastic return means for returning said piston and trigger lever to their rest position, and at least one compensation passage controlled by the piston movement to allow compensation air to flow into the container.

A sprayer device of the indicated type is known for example from German patent 2705071. In this patent the compensation passage opens into the cylinder, the piston controlling this opening such that it is closed it when the piston is in its rest position and open when the piston is moving.

The object of that patent is to prevent liquid escaping through the compensation passage when the container is not in an upright position or is inverted, for example during storage or transport, or during intervals between its use.

This known sprayer device has however the drawback of its piston being guided within the cylinder only along a very short axial distance, whereas for its remaining more extensive part the piston necessarily remains separated from the cylinder to enable air to enter the compensation passage. There is consequently the danger of the piston jamming within the cylinder during its active movement, this danger being enhanced by the fact that when operated, the trigger lever (which engages a groove in the piston via a tang) exerts a force on the piston which also has a transverse component favouring jamming. This jamming not only means that a greater force is required for operating the piston, but can also result in liquid leaking out during pumping.

This main object of the present invention is to provide a manual sprayer device of the specified type which overcomes the danger of the piston jamming and liquid leakage, with the advantage of achieving smooth and simple operation.

This and further objects which will be more apparent from the detailed description given hereinafter are attained by a sprayer device of the indicated type, characterised essentially in that during its movement within the cylinder the piston acts on a valve member positioned within the passage, to cause this latter to open.

The invention will be more apparent from the detailed description of a preferred embodiment thereof given hereinafter by way of nonlimiting example with reference to the accompanying drawings, in which.

Figure 1:
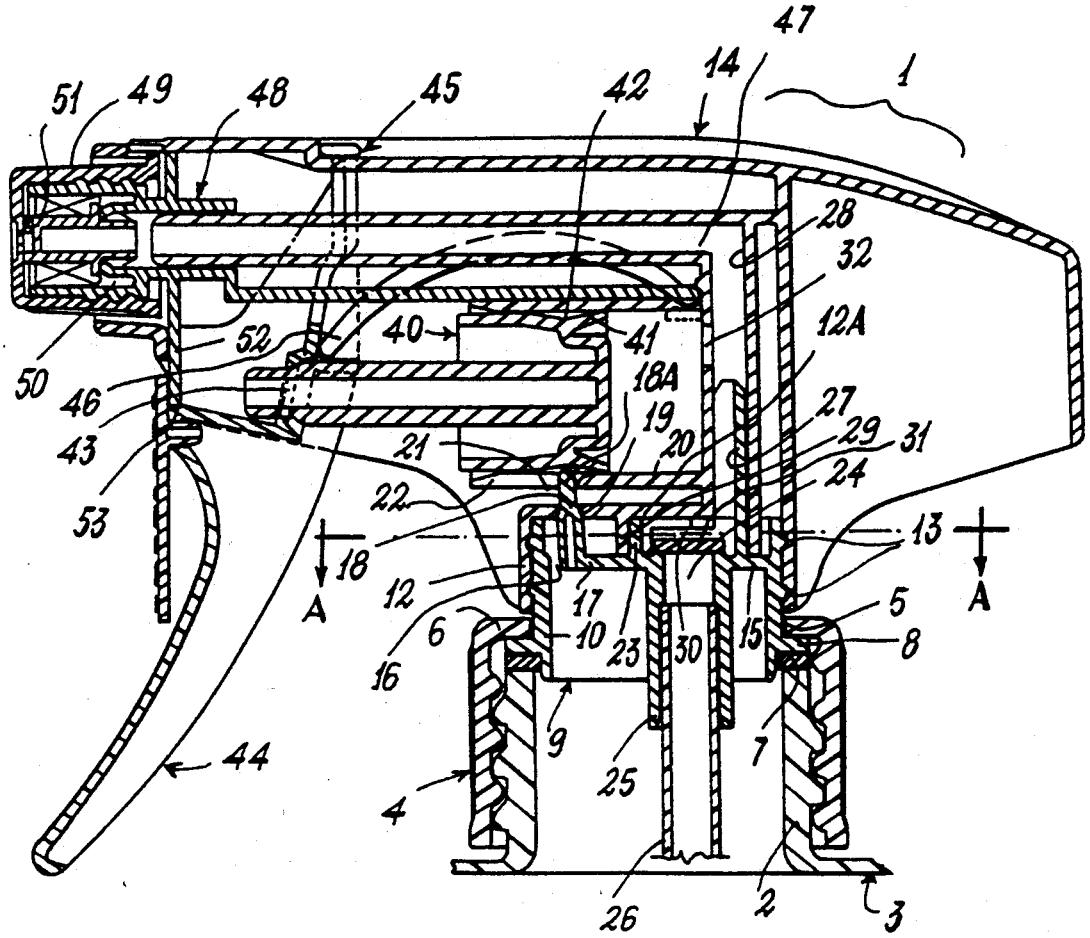
FIG. 1 is a longitudinal section through the sprayer device.
Figure 2:
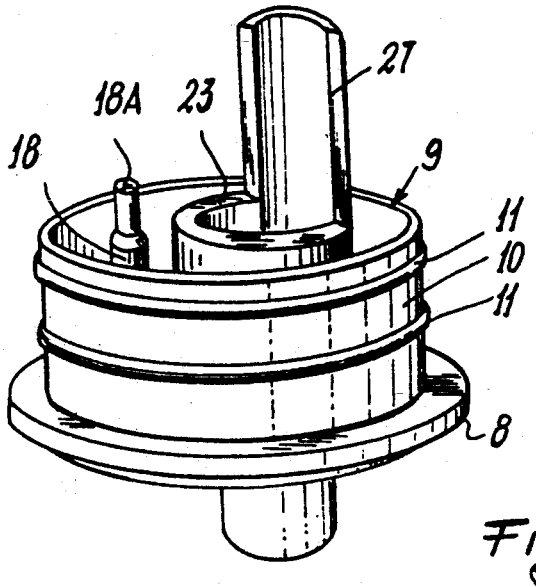
FIG. 2 is a perspective view of the insert carrying the valve member.
Figure 3:
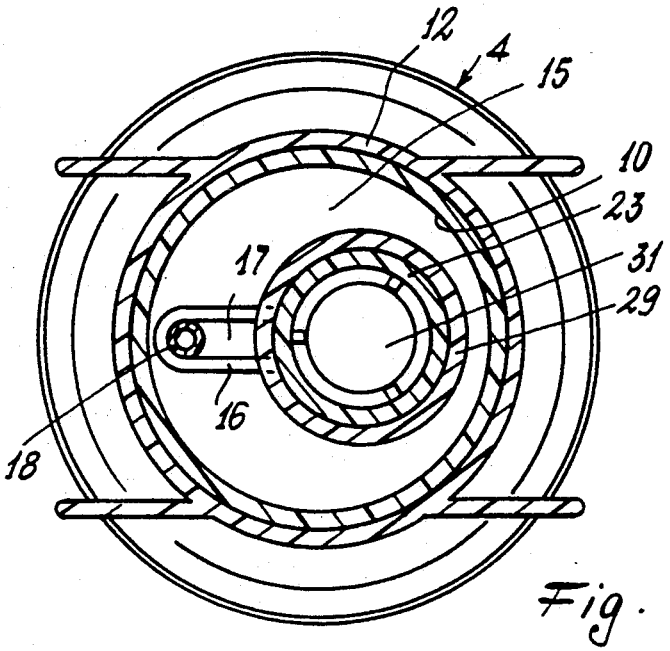
FIG. 3 is a section on the line A—A of FIG. 1.

With reference to the figures, the sprayer device, indicated overall by 1, is connected to the neck 2 of a container 3 containing the liquid to be dispensed, via a screw cap 4 provided with a top through hole 5. The hole 5 comprises an internal flange 6 along its contour. The flange 6 clamps a gasket 7 and the flange 8 of a plastics insert 9 onto the top of the neck 2.

The insert 9 has a circular wall 10 comprising two parallel circular beads 11 for its fluid-tight forced fitting into a cylindrical seat 12 provided with inner grooves 13 conjugate with said beads. The seat 12 forms part of the device body 14.

In an intermediate position the insert 8 comprises an inner transverse wall 15 provided with a radial aperture into which there projects a tongue 17 forming an integral part of the wall. At its free end, the tongue 17 (which is elastically flexible) carries a valve member 18 arranged to close a passage 19 provided in the top 12A of the cylindrical seat 12. The valve member 18 possesses a prolongation 18A which passes through an interspace 21 present between the wall 12A and a cylinder 20, and through a narrow longitudinal slot 22 in the cylinder, to penetrate a certain distance into this latter. The cylinder forms an integral part of the body 14.

The insert 9 also comprises a circular inner wall 23 surrounding the mouth 24 of a downwardly extending tubular appendix 25 forming part of the insert. A conventional dip tube 26 is inserted into this tubular appendix. To achieve correct centering of the insert 9 within the seat 12, the inner wall 23 has an arched extension appendix 27 which extends into a corresponding rising channel 28 in the body 14.

The inner wall 23 is inserted within a corresponding wall 29 projecting downwards from the wall 12A, to form a chamber 30 containing a freely movable plastics disc acting as a suction valve which closes the mouth 24. The chamber comprises an aperture from which said rising channel 28 commences.

A port 32 is provided in the rising channel 28 to connect it to the cylinder 20.

A piston 40 is slidingly mounted in the cylinder 20 and is guided practically over its entire length within the cylinder. The piston comprises a frontal seal ridge 41 and in proximity to this an annular groove 42 into which, when the piston is in its left end-of-travel position, the prolongation 18A of the valve member 18 penetrates to close the compensation passage 19, which when open allows environmental air to flow into the container 3. When the piston 40 moves from this position it presses the prolongation 18A and hence the valve member 18 downwards against the elastic reaction of the tongue 17 to open the compensation passage.

The piston 40 is connected at 43 to a trigger lever 44 hinged at 45 to the device body 14. The connection and hinging can be achieved in any known manner or be effected as described in a simultaneous patent application in the name of the present applicant, these therefore not forming part of the present invention.

Arched springs 46 interposed between the body 14 and trigger lever 44 return them into their rest position.

The channel 28 extends into a longitudinal channel 47 in the body 14. On the end of said channel 47 there is forcibly mounted a tubular member 48 which together with a spray nozzle 49 defines a chamber 50 containing a delivery valve 51 which also performs the function of facilitating liquid dispersion. With the tubular member 48 there is rigid a frontal wall 52, which closes the body 14 at its front and acts with its lower edge 53 as a stop for the trigger lever 44.

On operating the trigger lever 44, starting from the position shown in FIG. 1 in which the compensation passage 19 is closed, the piston 40 comprises the liquid contained in the cylinder and delivers it in spray form through the nozzle 49. In moving, it displaces the valve member 18, to open the compensation passage and hence allow environmental air to flow into the container 3. The compensation passage 19 remains open until the piston 40 is returned to its rest position by the springs 46.

I claim:

1. A liquid sprayer device fixable to a container (3) containing the liquid to be dispensed and comprising a body (14), a trigger lever (44) rotatably mounted within the body (14), a cylinder (20) arranged within said body (14), a piston (40) movable within the cylinder (20) and controlled by the trigger lever (44), elastic return means (46) for returning said piston (40) and trigger lever (44) to their rest position, and at least one compensation passage (19) controlled by the movement of the piston (40) to allow compensation air to flow into the container (3), such that during its movement within the cylinder (20), the piston (40) acts on a valve member (18, 18A) positioned within the passage (19) to cause the passage (19) to open, said piston (40) comprising an intermediate groove (42) which enables the valve member (18, 18A) to move into a position in which it closes the passage (19) when the piston (40) is substantially in its rest position.

2. A sprayer device as claimed in claim 1, characterised in that the valve member (18, 18A) is carried by an elastic tongue (17) of an insert (9) mounted in the body (14).

3. A device as claimed in claim 2, wherein the insert (9) is mounted in a seat (12) in the body (14), the compensation passage (19) being present within said seat (12), the valve member (18, 18A) having a prolongation (18A) passing through said compensation passage (19) and extending into the cylinder (20) via a slot (22) in said cylinder (20).

4. A device as claimed in claim 3, characterised in that the insert (9) defines with the seat (12) a valve chamber (30) containing a suction valve (31).

5. A device as claimed in claim 2, characterised in that a dip tube (26) is connected to the inset (9).

6. A liquid sprayer device fixable to a container (3) containing the liquid to be dispensed and comprising a body (14), a trigger lever (44) rotatably mounted within the body (14), a cylinder (20) arranged within said body (14), a piston (40) movable within the cylinder (20) and controlled by the trigger lever (44), elastic return means (46) for returning said piston (40) and trigger lever (44) to their rest position, and at least one compensation passage (19) controlled by the movement of the piston (40) to allow compensation air to flow into the container (3), such that the piston (40) during its movement within the cylinder (20) acts on a valve member (18, 18A) positioned within the passage (19) to cause the passage (19) to open, the valve member (18, 18A) being carried by an elastic tongue (17) of an insert (9) mounted in the body (14).

7. The device of claim 6, wherein said piston (40) comprises an intermediate groove (42) which enables the valve member (18, 18A) to move into a position in which it closes the passage (19) when the piston (40) is substantially in its rest position.

8. The device of claim 6, wherein the insert (9) is mounted in a seat (12) in the body (14), the compensation passage (19) being present within said seat (12), the valve member (18, 18A) having a prolongation (18A) passing through said compensation passage (19) and extending into the cylinder (20) via a slot (22) in said cylinder (20).

9. The device of claim 8, wherein the insert (9) defines with the seat (12) a valve chamber (30) containing a suction valve (31).

10. The device of claim 6, further comprising a dip tube (26) connected to the insert (9).

* * * * *